US008262256B2

(12) United States Patent
Biebl et al.

(10) Patent No.: US 8,262,256 B2
(45) Date of Patent: Sep. 11, 2012

(54) SEMICONDUCTOR LIGHT MODULE

(75) Inventors: Alois Biebl, St. Johann (DE); Stefan Dietz, Otterfing (DE); Günther Hirschmann, München (DE)

(73) Assignee: Osram AG, Munich (DE)

( * ) Notice: Subject to any disclaimer, the term of this patent is extended or adjusted under 35 U.S.C. 154(b) by 519 days.

(21) Appl. No.: 12/594,814

(22) PCT Filed: Apr. 3, 2007

(86) PCT No.: PCT/EP2007/053245
§ 371 (c)(1),
(2), (4) Date: Oct. 5, 2009

(87) PCT Pub. No.: WO2008/119392
PCT Pub. Date: Oct. 9, 2008

(65) Prior Publication Data

US 2010/0128479 A1 May 27, 2010

(51) Int. Cl.
*F21V 21/00* (2006.01)

(52) U.S. Cl. ..... 362/249.02; 362/249.01; 362/800

(58) Field of Classification Search ..... 362/249.01–249.02, 382, 800
See application file for complete search history.

(56) References Cited

FOREIGN PATENT DOCUMENTS

| | | |
|---|---|---|
| WO | WO 2004/100624 | 11/2004 |
| WO | WO 2005/108853 | 11/2005 |
| WO | WO 2006/066530 | 6/2006 |
| WO | WO2006/066530 | 6/2006 |

OTHER PUBLICATIONS

Cool Polymers: XP 002459115, http://www.coolpolyrmers.com/appsheets/files/hsthermalmanagementsolutions.pdf, Dec. 31, 2005.

*Primary Examiner* — William Carter
(74) *Attorney, Agent, or Firm* — Cozen O'Connor

(57) ABSTRACT

A semiconductor light module comprising: integrated drive electronics, a semiconductor light source applied to a disk-shaped module, the surface of which is electrically conductive, and wherein the module has good thermal conductivity. The drive electronics are positioned around the semiconductor light source, and the drive electronics comprise a circuit board having at least first and second conductor track levels. The first track level is oriented outward in the light emission direction in the installed state, and the second track level is enclosed by a closed cavity incorporated into the module. Ground-carrying lines of the circuit board are electrically connected to the surface of the module.

13 Claims, 14 Drawing Sheets

SEMICONDUCTOR LIGHT MODULE

RELATED APPLICATIONS

Figure 1:
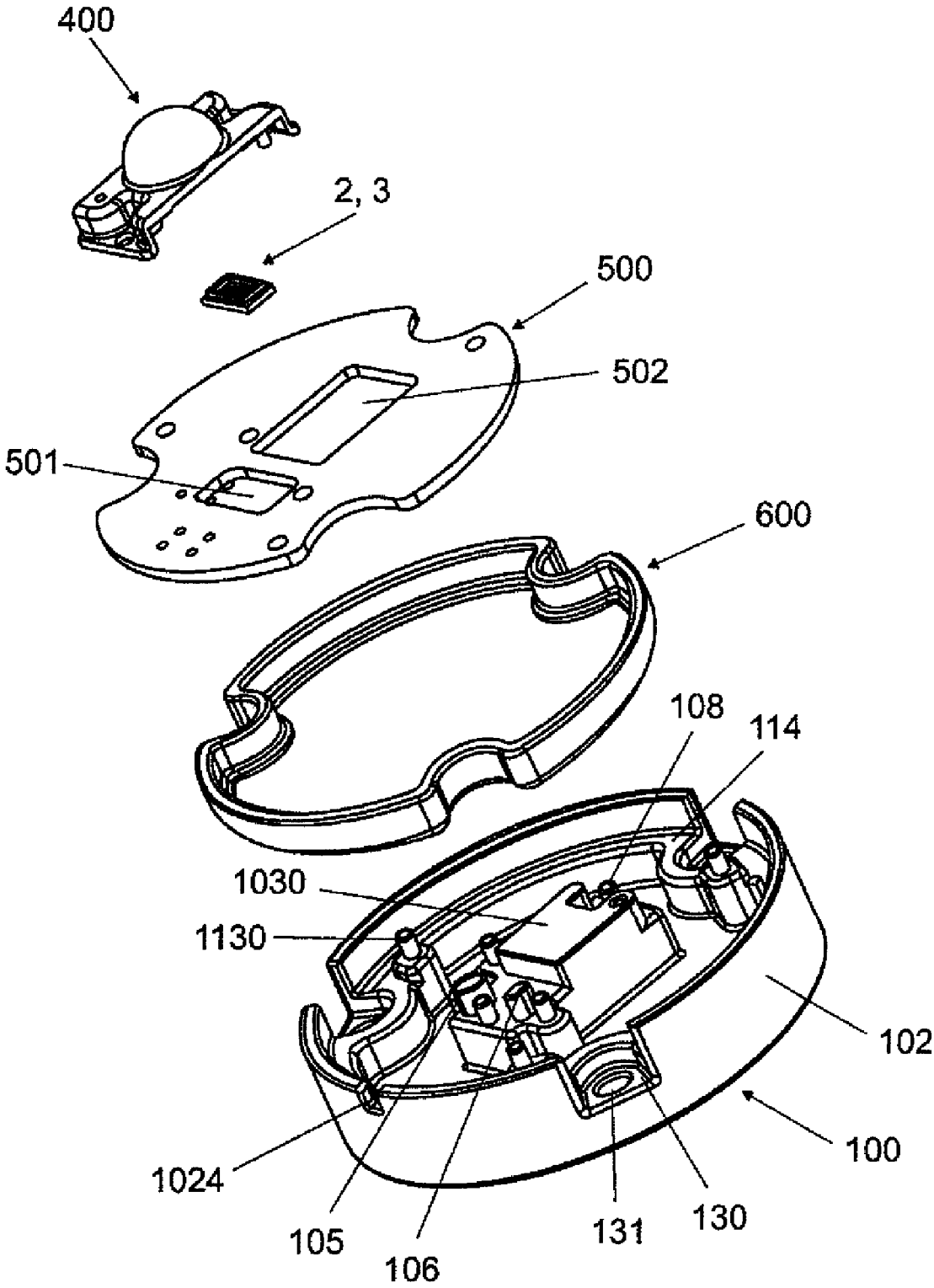

This is a U.S. national stage of application No. PCT/EP2007/053245, filed on Apr. 3, 2007.

FIELD OF THE INVENTION

The invention relates to a semiconductor light module with integrated drive electronics.

BACKGROUND OF THE INVENTION

A semiconductor light module of this type and a vehicle headlight of this type are disclosed for example in WO 2006/066530 A1. This published patent application describes a semiconductor light module comprising at least one light emitting diode chip, a housing embodied as a heat sink and partly surrounding the at least one light emitting diode chip, and a mount for fixing the at least one light emitting diode chip with respect to the heat sink in an unambiguous position and orientation, wherein the heat sink is provided with fixing means for mounting the semiconductor light module in a vehicle headlight.

Automotive applications have an increased requirement profile by comparison with applications in general lighting. It is necessary to withstand adverse ambient influences such as very high and very low temperatures, moisture and spray water, and the mechanical construction has to be made significantly more robust owing to the shocks and vibrations occurring in an automobile. Special requirements are made of the electronics, too. These include a very large input voltage range, it is necessary to withstand large voltage jumps and overvoltage spikes from the vehicle electrical system, as well as a very strict regimentation with respect to electromagnetic compatibility.

As can be seen from the prior art mentioned above, recently the semiconductor light sources have increasingly been applied directly to the heat sink, which ensures significantly increased heat dissipation. The drive circuit, however, will still be afforded space on a circuit board; therefore, the problem arises as to how the drive circuit and the semiconductor light sources can be afforded space on a semiconductor light module. Since modern semiconductor light sources such as e.g. LEDs or OLEDs are driven with high currents and often in pulsed fashion, semiconductor light modules often have the problem of electromagnetic interference. Use in a motor vehicle is always associated with little space being available, and since simple exchange of the module has to be made possible for reasons of service capability, it is necessary for the driving means of the semiconductor light sources and the semiconductor light sources themselves to form a unit that is as compact as possible.

SUMMARY OF THE INVENTION

It is an object of the invention, therefore, to specify a semiconductor light module in which the electromagnetic compatibility is improved by comparison with the prior art mentioned above.

This and other objects are attained in accordance with one aspect of the present invention directed to a semiconductor light module comprising: integrated drive electronics, a semiconductor light source applied to a disk-shaped module, the surface of which is electrically conductive, and the module has good thermal conductivity, wherein the drive electronics are positioned around the semiconductor light source, and wherein the drive electronics comprise a circuit board having at least first and second conductor track levels, and the first track level is oriented outward in the light emission direction in the installed state, and the second track level is enclosed by a closed cavity incorporated into the module, and wherein ground-carrying lines of the circuit board are electrically connected to the surface of the module.

The semiconductor light module according to an embodiment of the invention comprises a disk-shaped module having good thermal conductivity, on which one or more semiconductor light sources are arranged approximately in the center. This region is elevated relative to the surrounding region. Situated along the periphery of the module is a side wall which has approximately the same height as the elevated region on which the semiconductor light sources are situated. This gives rise to an interior space that is open in the light emission direction. A more deeply situated shoulder is present at the elevated region and at the side wall. The module is conductive at least at the surface and is electrically connected to the ground of the drive circuit. The drive circuit is situated on a round circuit board that has a slightly smaller diameter than the module and is cut out in the center in the region of the semiconductor light sources. This circuit board can be fixed to the module and bears in the center as well as at the edge on the shoulder. The interior space in the module is thus closed by the circuit board and the module and the circuit board form a cavity. The circuit board is electrically conductively connected to the module, and the semiconductor light sources are connected to the drive circuit on the circuit board.

This mechanical construction results in a compact semiconductor light module that ensures a good heat dissipation for the semiconductor light sources. The drive circuit is integrated on the module and the lines between the drive circuit and the semiconductor light sources can be kept very short. Through the cavity in the module, the circuit board can be populated with electronic components on both sides. The first conductor track level is oriented outward in the light emission direction, and the second conductor track level is oriented inward and is completely enclosed by the cavity.

In this case, all the circuits which cause electromagnetic interference are preferably situated on the second conductor track level.

A heat sink can be integrally fitted to the thermally conductive module, wherein the heat sink can have fin-type structures, but also separate cooling elements. The separate cooling elements can have various forms, e.g. honeycomb- or drop-shaped forms. In principle, all possible forms, but primarily axially symmetrical forms, are conceivable.

If the semiconductor light module is intended to be used for general lighting as a down light, then the heat sink can be embodied in tubular fashion with an e.g. honeycomb-shaped inner structure. It is thereby possible to achieve a chimney effect that produces a continuous air flow through the heat sink. An air inlet opening on the light-remote side of the module disk is necessary for this purpose.

In a further embodiment, it is provided that the heat sink is not part of the module disk, but rather can be fitted thereto.

The semiconductor light sources can be LEDs or else OLEDs.

In order to shield the electromagnetic interference generated by the circuit on the second conductor track level, it is expedient that the circuit board has a central layer that is electrically connected to the module disk, and is thus at ground potential.

BRIEF DESCRIPTION OF THE DRAWING(S)

FIG. 1 three-dimensional exploded view of the semiconductor light module according to a first embodiment of the invention.

Figure 2:
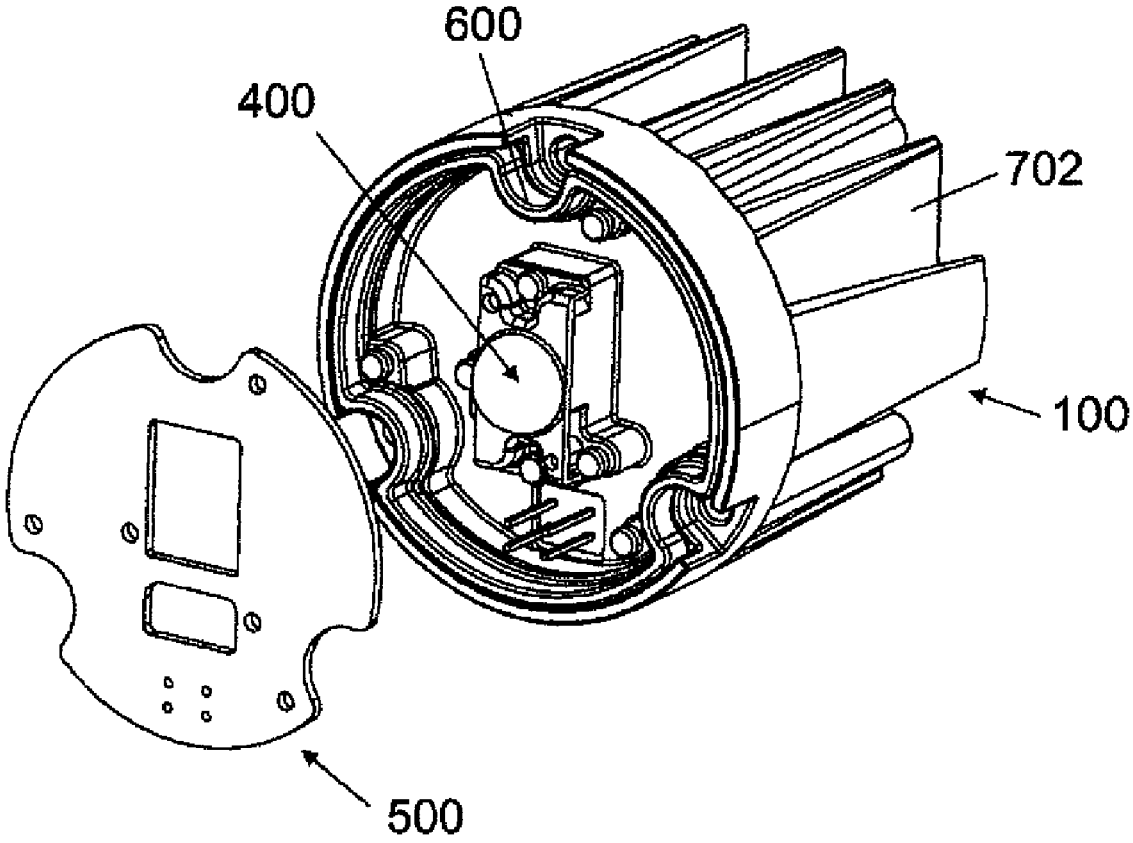

FIG. 2 isometric view of a second embodiment of the semiconductor light module according to the invention.

Figure 3A:
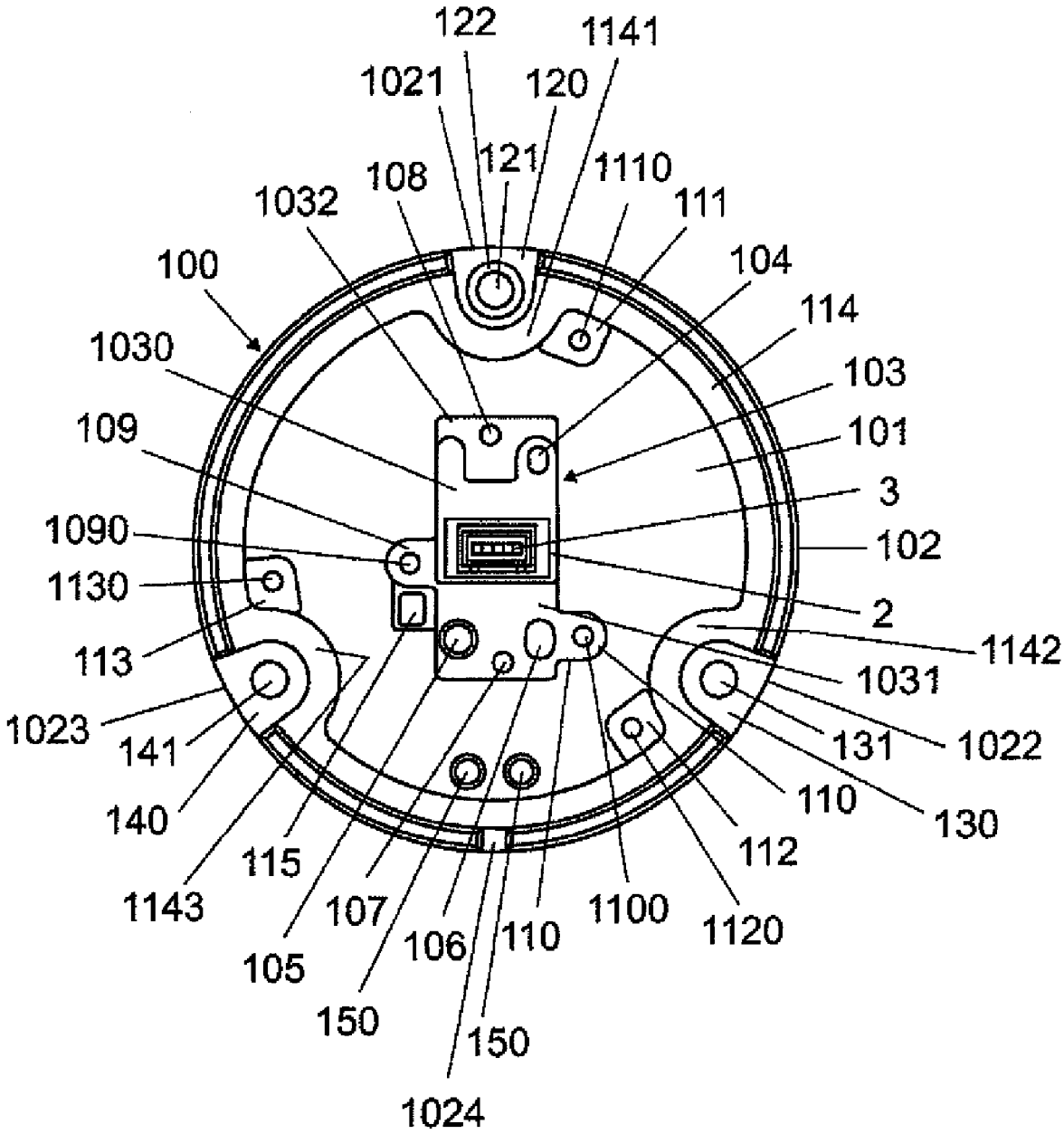

FIG. 3*a* plan view of a first embodiment of a semiconductor light module according to the invention.

Figure 3B:
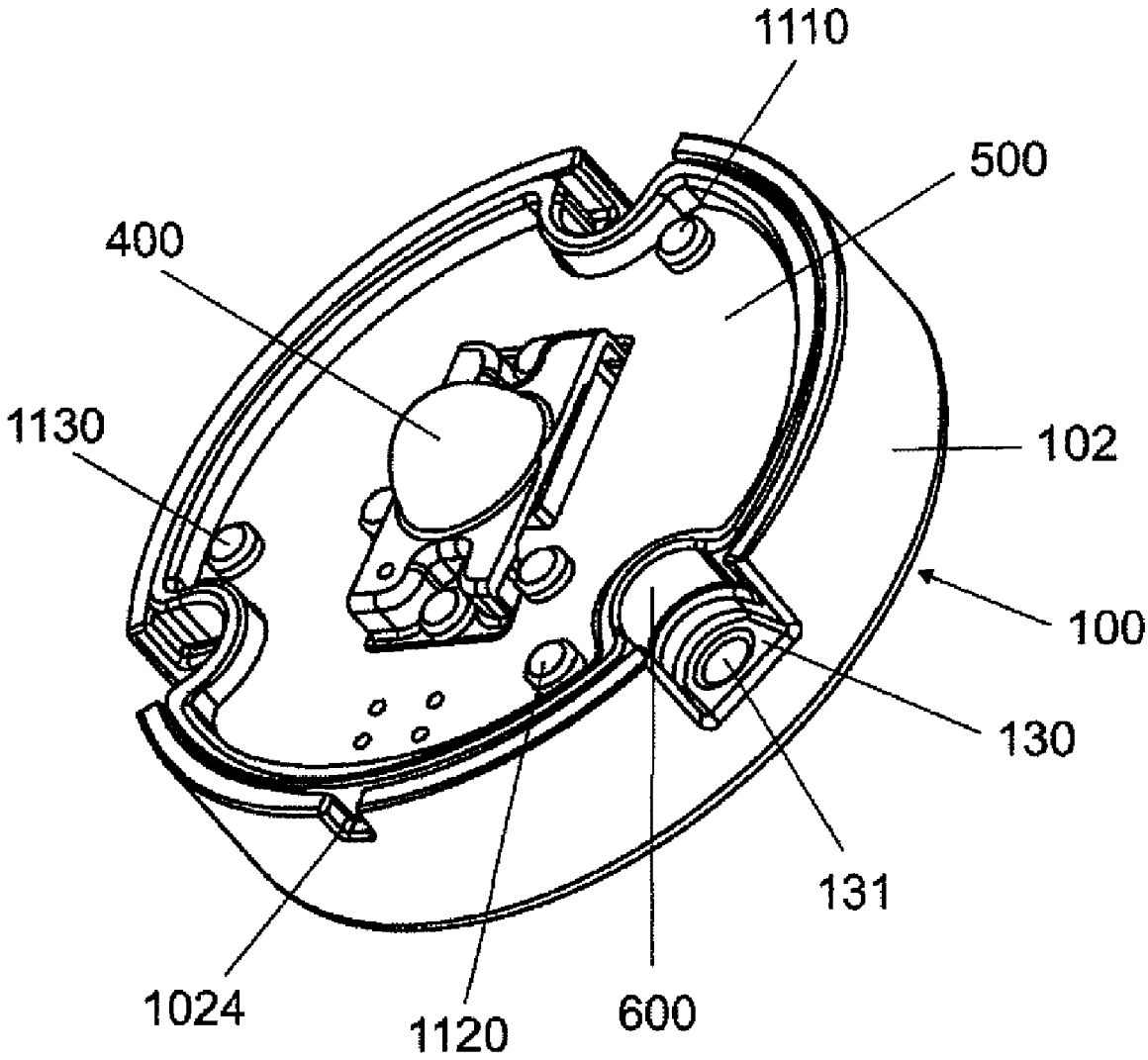

FIG. 3*b* oblique view of a second embodiment of the semiconductor light module according to the invention.

Figure 4:
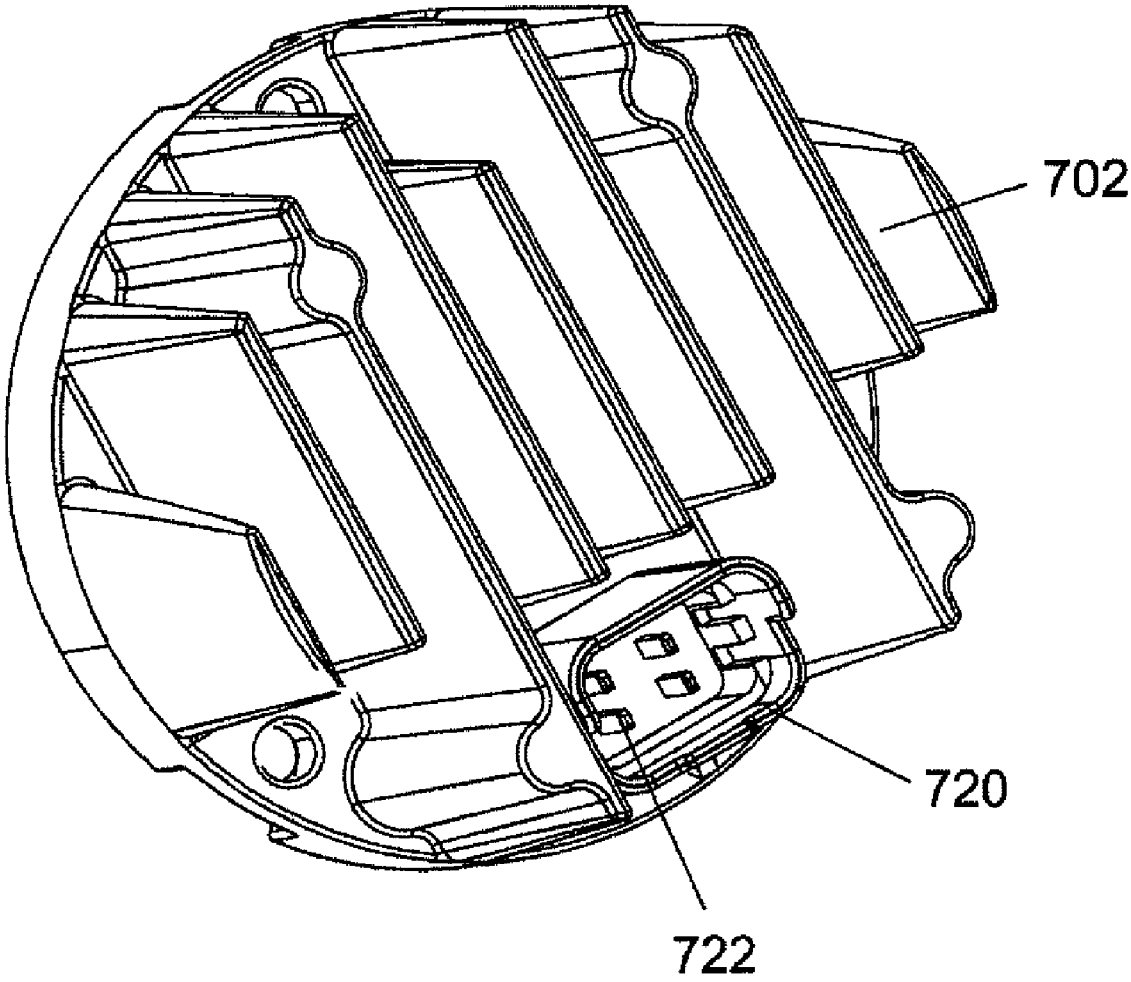

FIG. 4 isometric view of a first variant of the second embodiment of the semiconductor light module according to the invention.

Figure 5A:
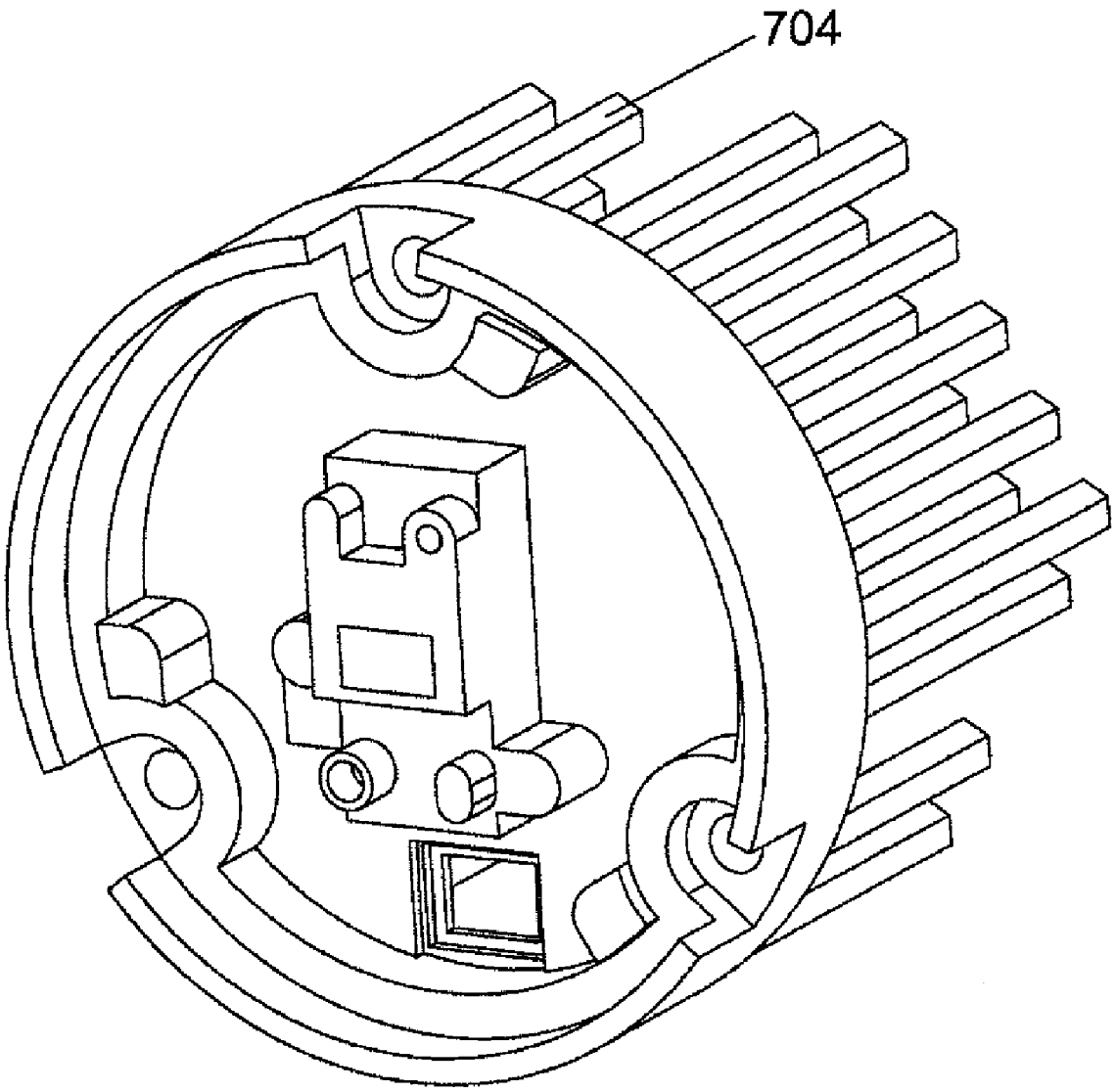
Figure 5B:
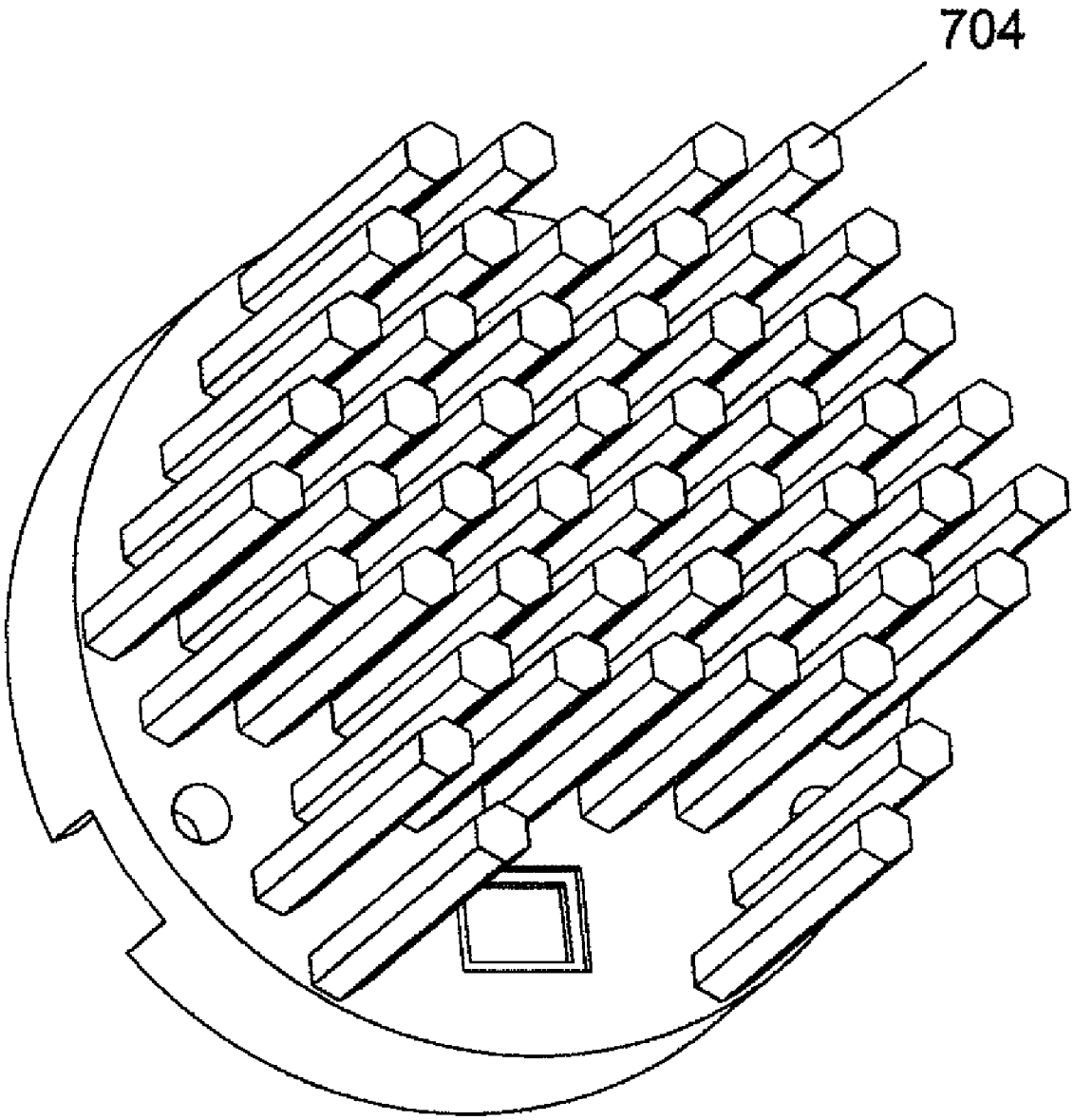

FIGS. 5*a*, 5*b* isometric view of a second variant of the second embodiment of the semiconductor light module according to the invention.

Figure 6A:
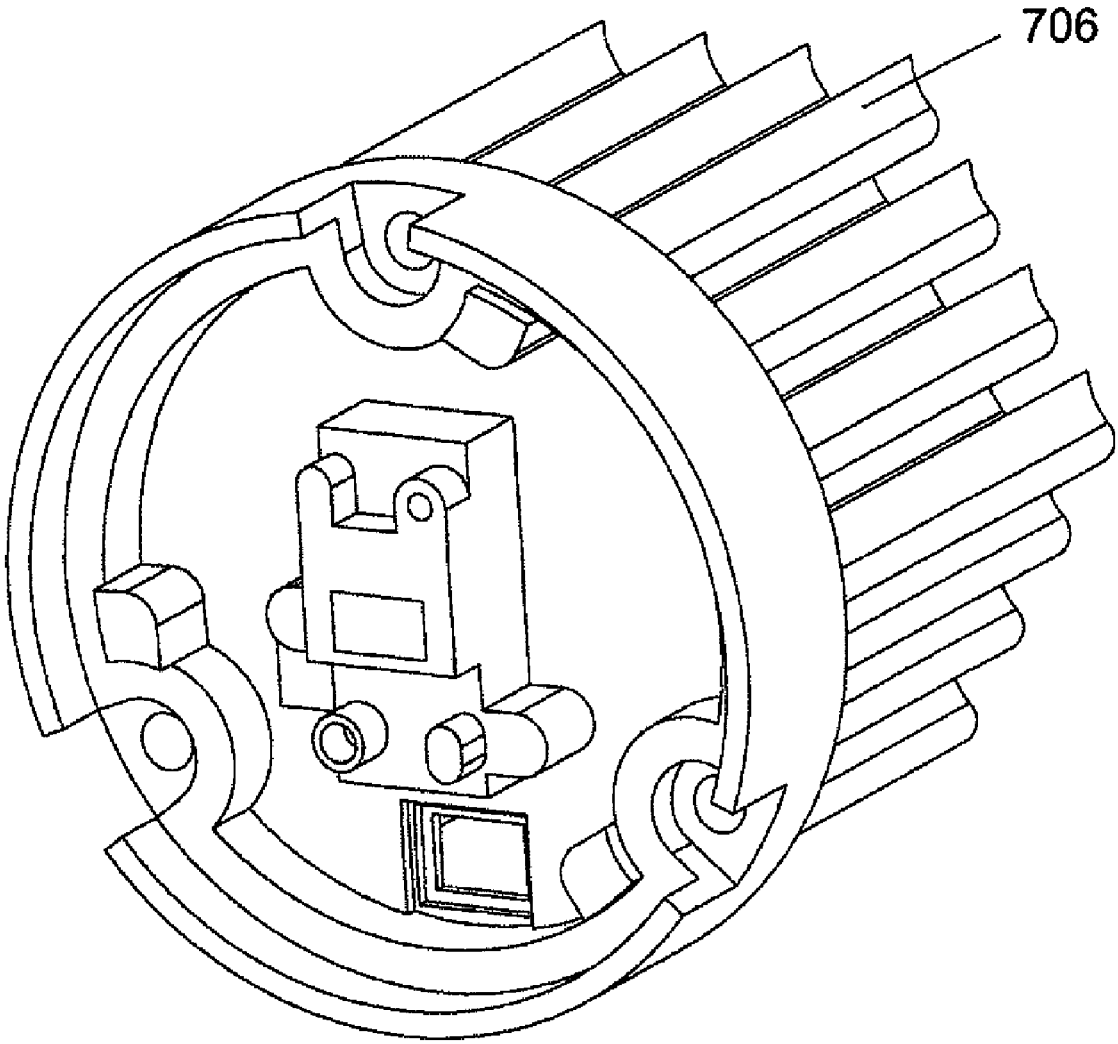
Figure 6B:
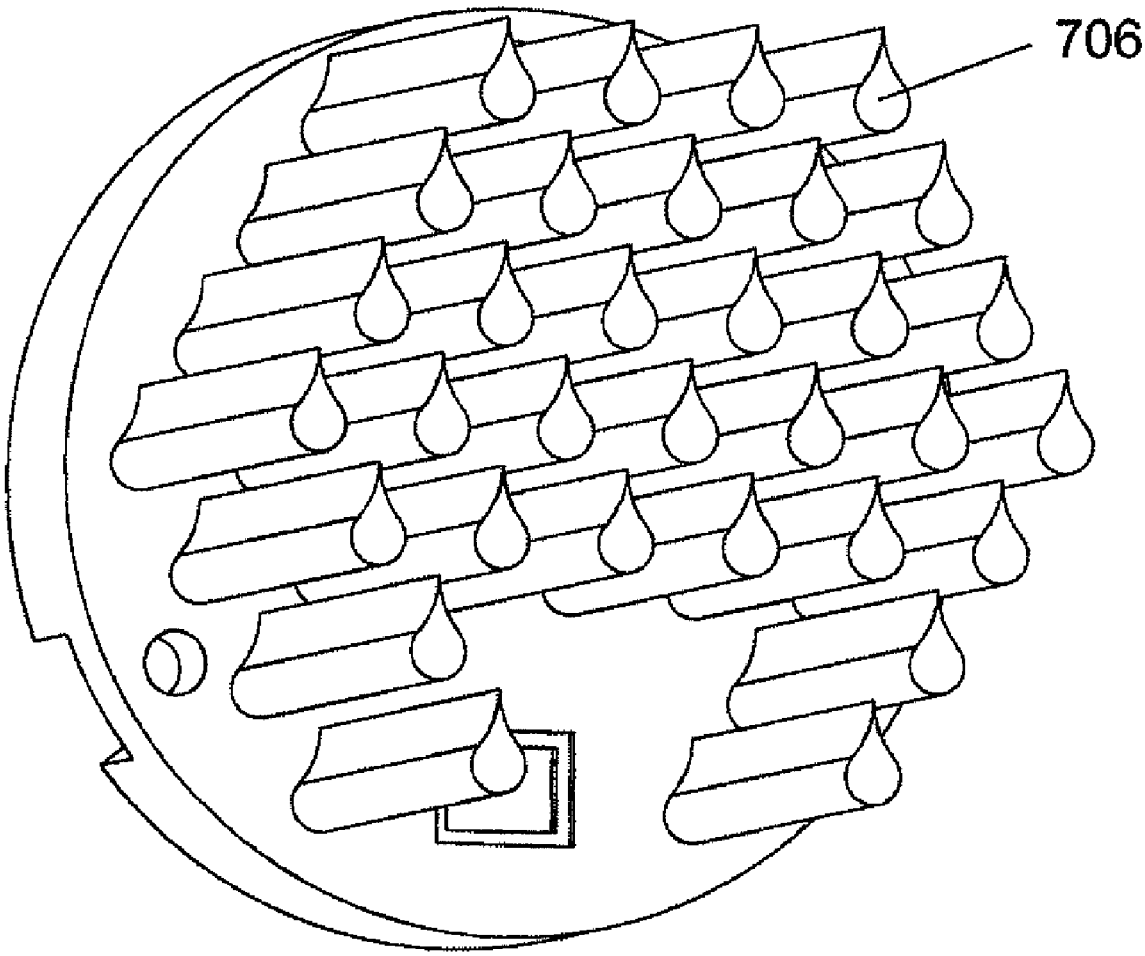

FIGS. 6*a*, 6*b* isometric view of a third variant of the second embodiment of the semiconductor light module according to the invention.

Figure 7A:
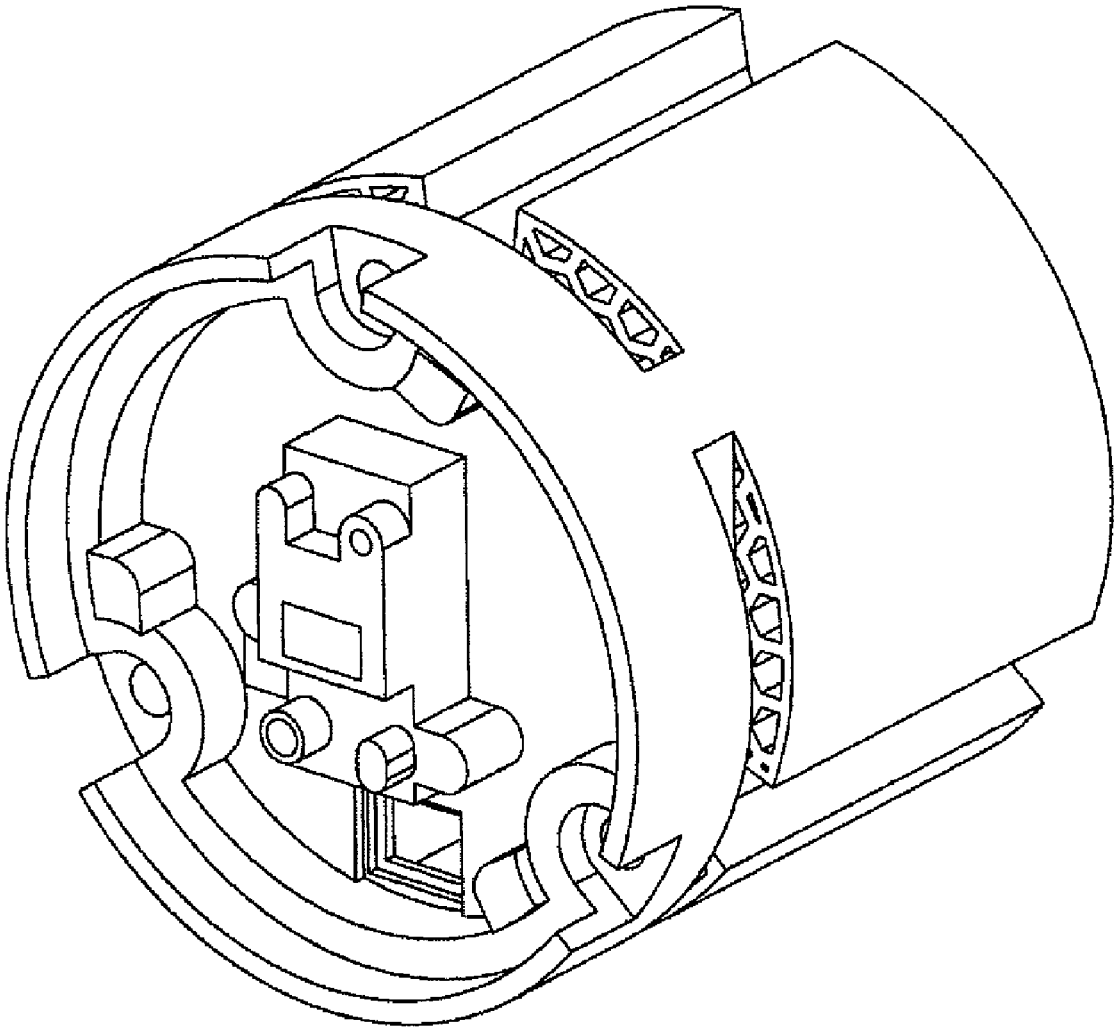
Figure 7B:
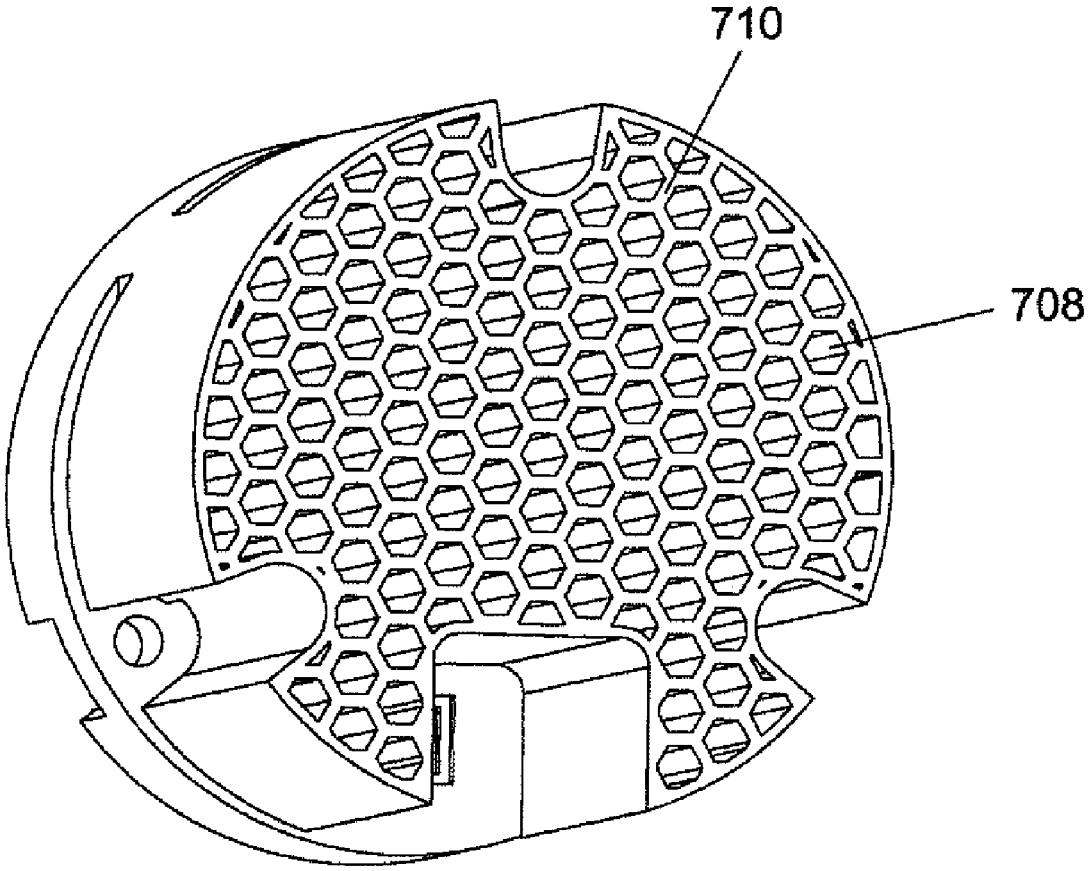

FIGS. 7*a*, 7*b* isometric view of a fourth variant of the second embodiment of the semiconductor light module according to the invention.

Figure 8:
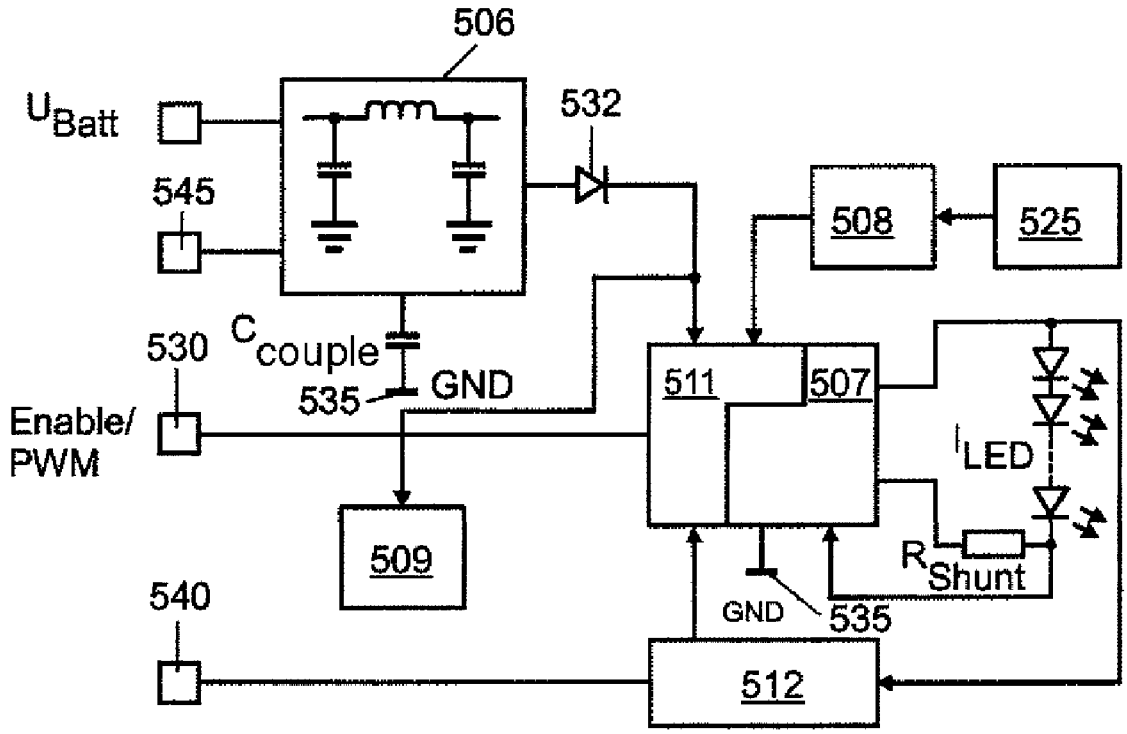

FIG. 8 block diagram of the drive logic arranged on the circuit board.

Figure 9A:
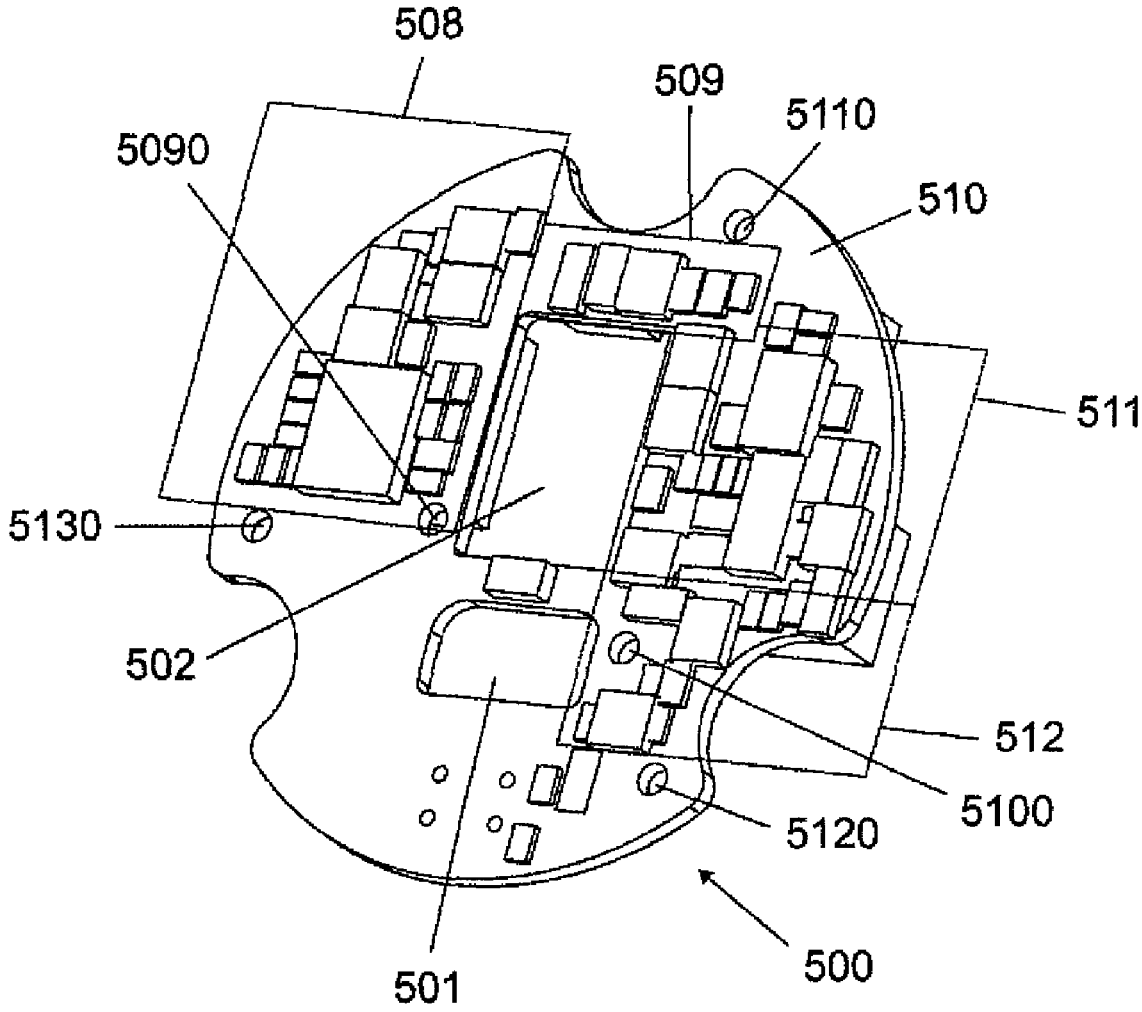
Figure 9B:
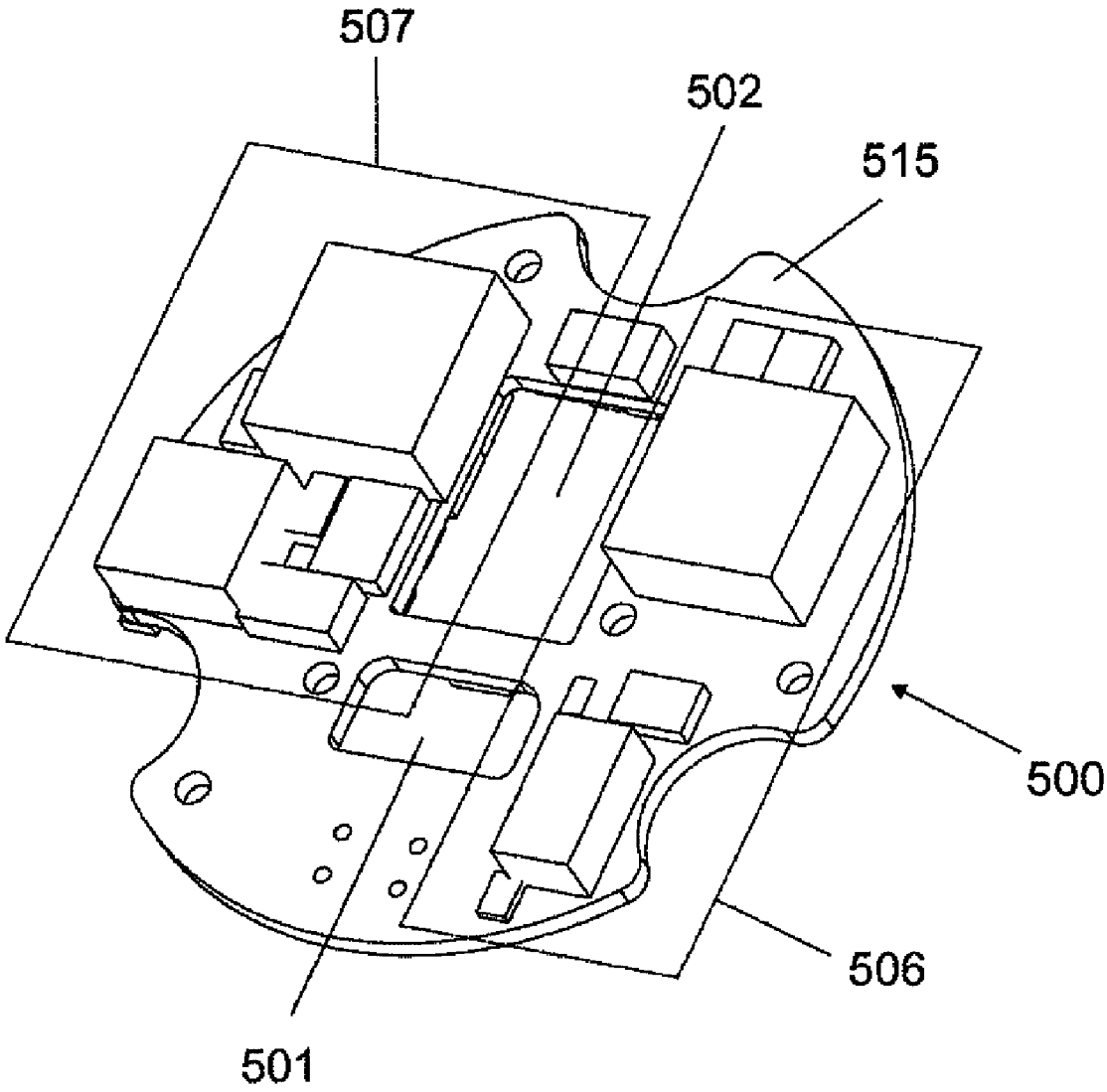

FIGS. 9*a*, 9*b* isometric view of the circuit board with the first and the second conductor track level.

DETAILED DESCRIPTION OF THE DRAWINGS

First Embodiment

The first embodiment is shown in FIGS. 1, 3*a* and 3*b*. It comprises a disk-shaped semiconductor light module to which a heat sink can be fixed.

The semiconductor light module in accordance with the first embodiment of the invention comprises a pot-like, substantially cylindrically symmetrical housing 100 composed of aluminum having a circular-disk-like base 101 and a side wall 102 integrally formed on the base 101 and running along the lateral surface of a cylinder. The base 101 and the side wall 102 form an interior space. The housing 100 is embodied in particular as a die cast aluminum part. The base 101 of the housing 100 has on its inner side an elevation 103 formed in one piece with the base 100, said elevation having a high central section 1030 and two more deeply situated plateaus 1031, 1032. The top side of the central section 1030 has a greater height above the base 101 of the housing 100 than the two plateaus 1031, 1032 arranged on different sides of the central section. The top side of the central section forms a bearing surface for a carrier plate 2 composed of ceramic, which serves as a carrier for five light emitting diode chips 3, and for a primary optical unit. The carrier plate ensures electrical insulation between the metallic housing 100 in particular the elevation 103, and the light emitting diode chips 3. The five light emitting diode chips 3 are arranged in a row on the carrier plate 2 and are surrounded by the walls of a frame. However, it is also possible to arrange six light emitting diode chips in two rows. The light emitting diode chips 3 emit blue light and are provided with a phosphor coating (chip layer coating) in order to convert the wavelength of part of the electromagnetic radiation generated by the light emitting diode chips 3, such that the illumination device emits light that appears white during its operation. The light emitting diode chips 3 are, for example, thin-film light emitting diode chips, the basic principle of which is described for example in the publication by I. Schnitzer et. al., Appl. Phys. Lett. 63 (16), Oct. 18, 1993, 2174-2176. The carrier plate 2 is adhesively bonded by means of an automatic placement machine on the top side of the central section 1030 of the elevation 103 at a predetermined distance and with a well-defined orientation with respect to a hollow-cylindrical web 105 arranged on the first plateau 1031 and with respect to an elongated hole 104 arranged on the second plateau 1032. The carrier plate 2 with the light emitting diode chips 3 arranged thereon is arranged between the elongated hole 104 and the hollow-cylindrical web 105. The top side of the cylindrical hollow web 105 and of the web 106 having an oval transverse web have the same height above the housing base 101 as the top side of the central section 1030.

In the region of the first plateau 1031, the elevation 103 has two lug-like integrally formed portions 109, 110 arranged on different sides of the plateau 1031 and respectively having a pin 1090, 1100. The pins 1090, 1100 serve for the riveting of a mounting circuit board 500, which bears on the top side of the first plateau 1031 and of the second plateau 1032 and also on three further bearing surfaces 111, 112, 113 provided with a respective pin 1110, 1120, 1130. The aforementioned bearing surfaces 111, 112, 113 are arranged equidistantly along the inner side of a ring-shaped web 114 running on the inner side of the side wall 102. The mounting circuit board 500 (FIGS. 9*a*, 9*b*) has two substantially rectangular perforations 501, 502, through which the central section 1030 and the webs 105, 106 and also the pins 107, 108 project. The components of an operating unit for the light emitting diode chips 3 are mounted on the mounting circuit board. In particular, the operating unit comprises an internal voltage supply 509, a fault detection logic 512, a derating logic 508, and a drive logic for a DC voltage converter 511, which lie on a first conductor track level 510, and also an input filter (506) and the DC voltage converter (507) for the power supply of the LEDs from the vehicle electrical system voltage of the motor vehicle, which lie on the second conductor track level 515. A thermistor 525, in particular a so-called NTC (negative temperature coefficient of resistance) thermistor, is connected to the derating logic 508. This logic ensures that the light emitting diode chips 3 are driven with reduced power in the event of excessively high temperature. The fault detection 512 signals the failure of an LED or of an LED string via a status output 540 (pin, e.g. embodiment by means of open collector). A display on the motor vehicle dashboard is thus possible. The input filter 506 ensures that no line-conducted interference can pass toward the outside via the current-carrying leads. The large power-carrying components that cause strong electromagnetic interference owing to their clocked operation therefore all lie on the second conductor track level 515, which is oriented inward into the interior space in the installed state of the circuit board 500. Consequently, only logic assemblies that are operated with small signal voltages from the internal voltage supply 509 are situated on the first conductor track level 510, which is oriented in the light emission direction. The circuit board 500 is connected to the housing 100 via five fixing points 1090, 1100, 1110, 1120, 1130. The fixing can be effected by screwing, riveting, soldering, welding, hot caulking, etc. The circuit board is preferably riveted onto the housing. This fixing produces a good electrical conductivity of the connection holes 5090, 5100, 5110, 5120, 5130 with respect to the housing 100. The connection holes are preferably connected to a third conductor track level, which carries only the ground potential. The third conductor track level is arranged inside in the circuit board between the first and the second conductor track level. The third conductor track level shields all interference that arises as a result of the power-carrying components on the second conductor track level 515. The line-conducted interference is filtered out by the input filter with $\pi$ topology (506). What is primarily crucial in this case is that the input filter of the LED drive circuit has a very good coupling to the ground conductor track level of the drive circuit. This coupling can be effected in terms of DC or AC. If a direct DC connection is not possible for circuitry reasons, said connection is produced in terms of AC. In terms of AC means via a coupling capacitor $C_{couple}$. The edge of the virtually circular-disk-shaped mounting circuit board 500 terminates with the inner side of the ring-shaped bearing surface 114 for the sealing ring 600, such that the mounting circuit board 500 with the ground-carrying conductor track level and the housing base 101 and also the ring-shaped web 114 and the sealing ring 600 lying thereon form a cavity that encloses all interfering components and shields the interference toward the outside. The semiconductor light module thus exhibits an optimum EMC behavior.

In order also to ensure optimum operation of the light emitting diode chips 3 besides the optimum EMC behavior the drive circuit should have further features. A constant-current regulation is necessary for optimum driving of the light emitting diode chips 3. A boost-buck converter topology (simultaneous step-up and step-down converter of a DC voltage converter) is recommended owing to the non-stable motor vehicle electrical system. In order to keep the heat generation of the semiconductor light module within limits, a good efficiency of the drive circuit of greater than 80% is necessary. The features of the fault diagnosis circuit and of the derating logic have already been discussed above, and therefore will not be repeated here. In order to keep the light emission of the headlight identical over the lifetime, a brightness setting (adjustment of the luminous flux of the LEDs in a predetermined window) can be implemented. For other applications, e.g. for a combined rear/brake light or for a dimmable luminaire in general lighting, it is possible to provide an input 530 for dimming by means of PWM (pulse width modulation). In order to preclude damage due to improper handling, e.g. due to incorrectly polarized connection of the semiconductor light module, a polarity reversal protection diode can be provided. If the semiconductor light module is designed for motor vehicle applications, an overvoltage protection (if higher voltages than the customary on-board voltage occur momentarily in the motor vehicle electrical system, owing to the switching of, especially inductive, loads, the drive circuit is not destroyed.) is normally required. A short-circuit strength of the output for the light emitting diode chips 3 can also be provided.

From the abovementioned features which an LED drive circuit for a semiconductor light module in a motor vehicle should have, it is possible to develop a circuit having the following block diagram illustrated in FIG. 8. In order that the drive circuit for the LEDs has a high efficiency, it is necessary to use a DC voltage converter 507. The heart of the LED driver is therefore a DC voltage converter 507, which has boost or buck converter properties, or a combination of both, depending on the number of light emitting diodes 3 connected. Since a DC voltage converter 507 operates with a specific frequency, it is necessary for technical EMC reasons to position an input filter (e.g. π filter) upstream of the actual DC voltage converter 507. In order not to adversely effect the mode of operation of the filter, the latter should have a direct connection or at least an indirect connection (in terms of alternating current) to the system ground (535) of the DC voltage converter and thus also to the cooling element (here: housing 100 with or without heat sink). The connection of the filter in terms of alternating current can be realized by means of a coupling capacitor $C_{couple}$. Since, for circuitry reasons, the input filter ground 545 can have a different reference ground than the rest of the LED drive circuit (system ground 535), the measure described above has to be implemented. A polarity reversal protection diode, which is intended to protect the LED drive circuit against polarity reversal, is connected downstream of the input filter 506. Besides the passive polarity reversal protection by means of a diode as shown in FIG. 8, with a Schottky diode being expedient, of course, an active polarity reversal protection by means of MOSFET is likewise possible. A derating circuit 508, to which a temperature sensor 525 (e.g. NTC thermistor) is connected, provides for a temperature-dependent current regulation, for protecting the LED against thermal destruction. The temperature sensor 525, as a result of thermal coupling to the LEDs (or the LED string or the LED array), monitors the temperature thereof. Any instance of the forward current $I_{LED}$ of the LED being exceeded into the forbidden range (according to the data sheet of the LEDs used) leads immediately to a reduction of said current. A fault detection circuit 512 is also implemented besides the temperature monitoring circuit 508 (derating). If an interruption in the LED string, comprising at least one LED, prevails at the LED driver output, or if no LED is connected, this is signaled at the fault detection output 540. This output is expediently embodied as an open collector. This affords the possibility of connecting various logics (which are connected via e.g. pull-up resistors) with different voltages for the further processing of the fault signal.

Alongside the lug-like integrally formed portion 109 and the hollow-cylindrical web 105, a trough 115 is formed in the elevation 103, said trough being filled with a thermally conductive paste. The thermistor (525) is arranged on the trough 115, said thermistor being in contact with the thermally conductive paste and serving as a temperature sensor for measuring the operating temperature of the light emitting diode chips 3. The side wall 102 has three cutouts 1021, 1022, 1023 which are arranged along the periphery of the housing 100 and in which a surface 120, 130, 140 running parallel to the housing base 101 is respectively arranged. These surfaces 120, 130, 140 are situated at the same height above the housing base 101 and are respectively delimited by an indentation 1141, 1142, 1143 of the ring-shaped web 114, said indentation being directed into the interior of the housing 100. Arranged in the first surface 120 is a continuous hole 121 which is constricted in stepped fashion in the direction of the housing base 101 and which extends from the surface 120 as far as the outer side of the housing base 101. The hole 121 is embodied in such a way that a circular-cylindrical depression 122 is arranged in the surface 120, the outer radius of which depression corresponds to the first, large radius of the hole 121 and the inner radius of which depression corresponds to the second, small radius of the hole. The depth of the hole 121 is just a few millimeters in the region of the first, large radius, while the region of the hole 121 in the region of the second, small radius extends from the bottom of the depression 122 as far as the outer side of the housing base 101. That is to say that the height of the bottom of the depression 122 above the housing base 101 is only a few millimeters smaller than the height of the surfaces 120, 130, 140 above the housing base 101. A respective continuous hole 131, 141 is likewise arranged in the other two surfaces 130, 140, the radius of said hole in each case corresponding to the radius of the narrow region of the first hole 121. Furthermore, two perforations 150 are arranged in the housing base 101, said perforations serving for leading through electrical connection cables for the power supply of the components of the operating unit which are mounted on the mounting circuit board. Moreover, the housing base 101 preferably has three further holes for fixing a heat sink (not depicted). Besides the pure cable version, a variant with a connector as in the second embodiment is likewise available as well.

Second Embodiment

The second embodiment differs from the first embodiment in that a heat sink is integrally formed in one piece on the semiconductor light module. Since the design is otherwise the same as in the first embodiment, only the differences with respect to the first embodiment are described here.

The second embodiment is shown in different variants in FIGS. 2, 4, 5*a*, 5*b*, 6*a*, 6*b*, 7*a* and 7*b*. This embodiment has a heat sink integrally formed in one piece on the semiconductor light module. This has the advantage of better heat dissipation and also of simpler and thus more cost-effective mounting of the entire semiconductor light module. Instead of the two perforations 150 for the connection cables, a perforation for a connector socket is present. However, a cable version as described in the first embodiment can also be provided. Different variants are conceivable for the embodiment of the heat sink.

The performance of a heat sink essentially depends on what conditions prevail in the volume in which the heat sink is situated. If forced ventilation is present, the heat sink can be shaped differently than if only natural convection can be utilized. Only natural convection can be utilized in most luminaries, primarily in vehicle headlights. A vehicle headlight emits its light approximately horizontally over the base; therefore, the semiconductor light module is also installed with approximately horizontal orientation in the headlight.

In the first variant of the second embodiment, the heat sink has a fin-type structure. Since the air is heated at the heat sink, natural convection from the bottom to the top will take place. Therefore, in the case of this method, the installation position of the module has to be known in order, at its installation location, to orient the cooling fins into the air flow in order thus also to achieve a maximum cooling effect. In other words, here the user has to take account of the position of the installation location. It can furthermore happen that air that flows in the interior of the channel formed by the fins 702 does not come into contact with the heat sink wall and therefore cannot dissipate heat from the latter. This reduces the maximum possible cooling effect. As can be seen in FIG. 4, the cooling air is otherwise disturbed in its flow only by the connector socket 720 integrally formed on the light-remote side and having the contacts 722.

The first variant of the second embodiment is a heat sink having separate cooling elements, e.g. honeycomb-like domes 704, as shown in FIGS. 5*a* and *b*. In the case of this heat sink concept, the air can flow through the heat sink in all directions; therefore, the installation position no longer has to depend on the air flow. An additional cooling effect is achieved by virtue of the fact that the cooling elements are placed "interstitially" and so the air cannot flow through the honeycomb domes in an unimpeded manner, as in the case of a fin form of the heat sink. As a result of a forced turbulence, formation of a flow channel is prevented and the entire air is utilized for dissipating heat.

Turbulences of the air flows on the flow-remote side of a cooling element result in a reduction in the flow rate and hence the heat emission as a result of convection. This disadvantage can be avoided by choosing an aerodynamically improved form of the cooling elements, thus e.g. an improved drop form 706 of the third variant, as indicated in FIGS. 6*a* and *b*. Here, too, the effect of the flow channel formation can be produced by offset positioning of the cooling elements 706. In the case of this form, however, the installation position again has to be taken into consideration since the aerodynamic form can manifest its advantages only in the case of a known air flow direction, e.g. by means of a fan or by means of natural convection from the bottom to the top.

If the heat source is situated below the heat sink, a uniform flow and thus a chimney effect can be produced by means of a symmetrical tubular structure. The fourth variant of the second embodiment has a honeycomb-like structure with webs 710 and honeycomb-shaped openings 708 (FIGS. 7*a* and *b*). However, this form of cooling presupposes that the light emitting diode chips 3 are situated at the lower end of the luminaire and therefore emit virtually perpendicularly downward. This application is rather rare in automotive use, but plays a part e.g. in general lighting. One possible application would be down lights, in which the chimney effect can be utilized by means of such a honeycombed heat sink.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A semiconductor light module comprising:

integrated drive electronics, a semiconductor light source applied to a disk-shaped module, the surface of which is electrically conductive, and wherein the module has good thermal conductivity, wherein the drive electronics are positioned around the semiconductor light source, and wherein the drive electronics comprise a circuit board having at least first and second conductor track levels, and the first track level is oriented outward in the light emission direction in the installed state, and the second track level is enclosed by a closed cavity incorporated into the module, and wherein ground-carrying lines of the circuit board are electrically connected to a surface of the module wherein circuits which cause electromagnetic interference are predominantly situated on the second conductor track level.

2. The semiconductor light module as claimed in claim 1, wherein the semiconductor light module has an integrally formed heat sink.

3. The semiconductor light module as claimed in claim 2, wherein the heat sink is provided with cooling fins.

4. The semiconductor light module as claimed in claim 2, wherein the heat sink is provided with separate cooling elements.

5. The semiconductor light module as claimed in claim 4, wherein the separate cooling elements have an axially symmetrical form.

6. The semiconductor light module as claimed in claim 4, wherein the separate cooling elements have a honeycomb or drop form.

7. The semiconductor light module as claimed in claim 2, wherein the heat sink has a tubular structure, and wherein an air entrance opening is situated at the lower edge of the heat sink, such that an air circulation is promoted by the chimney effect that occurs.

8. The semiconductor light module as claimed in claim 1, wherein an external heat sink is fitted to the semiconductor light module.

9. The semiconductor light module as claimed in claim 1, wherein the semiconductor light source comprises at least one LED.

10. The semiconductor light module as claimed in claim 1, wherein the semiconductor light source comprises at least one OLED.

11. The semiconductor light module as claimed in claim 1, wherein the circuit board has a third conductor track level and wherein said third conductor track level is a ground level and is electrically connected to the module surface.

12. The semiconductor light module as claimed in claim 1, wherein an input filter, which is linked to a vehicle ground/ground, is linked to the ground carrying line of the drive circuit either directly or via a coupling capacitor.

13. The semiconductor light module as claimed in claim 1, wherein the module is composed of aluminum.

* * * * *